US008376882B2

(12) United States Patent
Shaffer et al.

(10) Patent No.: US 8,376,882 B2
(45) Date of Patent: Feb. 19, 2013

(54) UNLOADING BOLT

(75) Inventors: Michael J. Shaffer, Mogadore, OH (US); Richard W. Gardner, Norton, OH (US); Richard J. Bednar, Munroe Falls, OH (US)

(73) Assignee: Hunter's Manufacturing Company, Inc., Suffield, OH (US)

( * ) Notice: Subject to any disclaimer, the term of this patent is extended or adjusted under 35 U.S.C. 154(b) by 288 days.

(21) Appl. No.: 12/494,665

(22) Filed: Jun. 30, 2009

(65) Prior Publication Data

US 2010/0031945 A1 Feb. 11, 2010

Related U.S. Application Data

(60) Provisional application No. 61/086,920, filed on Aug. 7, 2008, provisional application No. 61/119,175, filed on Dec. 2, 2008.

(51) Int. Cl.
*F42B 6/02* (2006.01)
*F42B 6/04* (2006.01)
*F41B 5/14* (2006.01)

(52) U.S. Cl. ..... 473/578; 473/585; 473/586; 124/25; 124/85; 124/86; 124/90

(58) Field of Classification Search ..... 124/25, 124/85, 86, 90; 473/585, 586, 578
See application file for complete search history.

(56) References Cited

U.S. PATENT DOCUMENTS

| | | | | | |
|---|---|---|---|---|---|
| 2,620,190 | A * | 12/1952 | Bean | 473/585 |
| 2,940,759 | A * | 6/1960 | West | 473/585 |
| 3,150,875 | A * | 9/1964 | Searles | 473/577 |
| 3,427,976 | A * | 2/1969 | Lucy | 102/507 |
| 3,617,060 | A * | 11/1971 | Iezzi | 473/581 |
| 4,463,953 | A * | 8/1984 | Jordan | 473/581 |
| 4,726,584 | A * | 2/1988 | Bishop | 473/577 |
| 4,729,320 | A * | 3/1988 | Whitten, III | 102/371 |
| 4,762,328 | A * | 8/1988 | Beyl | 473/585 |
| 4,772,029 | A * | 9/1988 | Watkins | 473/578 |
| 4,881,743 | A * | 11/1989 | Fiorenzo | 473/577 |
| 5,035,435 | A * | 7/1991 | Burgeson et al. | 473/577 |
| 5,123,657 | A * | 6/1992 | Colt et al. | 473/577 |
| 5,154,432 | A * | 10/1992 | Saunders | 473/578 |
| 5,183,259 | A * | 2/1993 | Lyon | 473/581 |
| 5,234,220 | A * | 8/1993 | Schellhammer et al. | 473/578 |
| 5,269,535 | A * | 12/1993 | Gagne | 473/585 |
| 5,303,496 | A * | 4/1994 | Kowalkowski | 43/1 |
| 5,423,553 | A * | 6/1995 | Krieg | 473/586 |
| 5,823,902 | A * | 10/1998 | Guest et al. | 473/578 |
| 5,836,842 | A * | 11/1998 | McLearan | 473/581 |
| 5,842,942 | A * | 12/1998 | Doht et al. | 473/578 |
| 6,027,036 | A * | 2/2000 | Taylor | 239/53 |
| 6,174,251 | B1 * | 1/2001 | Lemote | 473/581 |
| 6,186,913 | B1 * | 2/2001 | Thomas | 473/581 |
| 6,450,905 | B1 * | 9/2002 | Edlund | 473/581 |
| 6,745,950 | B1 * | 6/2004 | Longo | 239/44 |
| 7,488,267 | B2 * | 2/2009 | Hunt | 473/581 |
| 7,601,084 | B2 * | 10/2009 | Martin | 473/578 |
| 7,731,612 | B2 * | 6/2010 | Martin | 473/581 |
| 2006/0287144 | A1 * | 12/2006 | Martin | 473/578 |
| 2007/0026978 | A1 * | 2/2007 | Martin | 473/578 |
| 2008/0051231 | A1 * | 2/2008 | Everett | 473/578 |

* cited by examiner

*Primary Examiner* — Gene Kim
*Assistant Examiner* — Alexander Niconovich
(74) *Attorney, Agent, or Firm* — Brouse McDowell

(57) ABSTRACT

A device for allowing a crossbow to be released from a drawn position without damaging the crossbow. The device may comprise an elongated member having a substantially cylindrical shape that can be positioned on the upper surface of the barrel of a crossbow. The device may comprise a notched end shaped to receive the bowstring of the crossbow and allows the device to be projected by the bowstring upon actuation of the crossbow's trigger lever.

14 Claims, 7 Drawing Sheets

UNLOADING BOLT

This application claims priority to U.S. Ser. No. 61/086,920, titled UNLOADING BOLT, filed Aug. 7, 2008, which is incorporated herein by reference; and, this application claims priority to U.S. Ser. No. 61/119,175, titled UNLOADING BOLT, filed Dec. 2, 2008, which is incorporated herein by reference.

I. BACKGROUND OF THE INVENTION

A. Field of Invention

This invention relates generally to the field of crossbows and, more specifically, to apparatuses and methods for unloading crossbows.

B. Description of the Related Art

Crossbows have been used for many years as a weapon for hunting and fishing, and for target shooting. In general, a crossbow includes a main beam including a stock member and a barrel connected to the stock member. A pair of bow limbs extend transversely from the end of the main beam. A riser block can be used to operatively connect the bow limbs to the main beam. Alternately, the bow limbs can comprise a single structure coupled directly to the main beam. A bowstring is operatively connected to the ends of the bow limbs and extends across the upper surface of the barrel. To cock and load the crossbow, the bowstring is drawn rearwardly toward the stock until it is received and retained by a trigger assembly. With the bowstring drawn, an arrow can be placed on a flat surface of the barrel of the crossbow in front of the bowstring. The trigger assembly, supported on the main beam, holds the bowstring in a drawn or cocked condition and can be operated to selectively release the bowstring to shoot the arrow.

Drawing the bowstring tends to cause the arms of the crossbow to move towards each other, thereby storing potential energy in the arms. To increase the amount of force provided by the crossbow and to reduce the force necessary for drawing the bowstring, the bow assembly may include a series of cams (pulleys, eccentrics, or wheels) and/or cables operatively connected to the ends of the bow limbs. The cams are rotatably attached to the bow limbs and receive the bowstring to reduce the amount of force required to draw the bowstring and/or increase the amount of force provided by the crossbow. Commonly, two or more cables are utilized to pull or bend the bow limbs inward, generally toward the main beam, as the bowstring is drawn. The cables may be received by the cams and coupled to the ends of the bow limbs. As the cams rotate, the cables travel across the cams thereby reducing the effective length of the cables and causing the bow limbs to be pulled generally inward.

When the bowstring is released from the trigger assembly, the potential energy stored in the arms of the crossbow is transferred through the bowstring and to the arrow which is then propelled or fired from the crossbow. Dry firing a crossbow refers to releasing the crossbow from the drawn position when the crossbow is unloaded (i.e., an arrow is not positioned on the flat surface of the barrel in front of the drawn bowstring). Instead of being used to propel an arrow, when dry fired, the potential energy generated by drawing the bowstring remains in the bow limbs. Dry firing can cause injury to the user as well as damage to the bowstring, cables, limbs, cams, and other components.

Commonly, when hunting, the user will cock or draw the crossbow upon initially setting into their hunting position, for example, a tree stand or ground blind. The crossbow is then left in a cocked or drawn position until the user either fires the crossbow or desires to move from their current hunting position. Because it is unsafe to transport or store the crossbow while it is cocked or drawn, before leaving their current position the user must safely un-cock or return the crossbow to an un-drawn position. Conventional methods for un-cocking the crossbow include firing an arrow into a suitable target or rock-free ground. The user may carry a practice arrow specifically for unloading the crossbow.

Although known methods of unloading or un-cocking a crossbow work well for their intended purpose, several disadvantages exist. Firing a practice arrow into a suitable target or rock-free ground may cause the arrow to be damaged, lost, or otherwise unusable. Losing or damaging the practice arrow creates an additional expense to the user and requires the user to carry multiple practice arrows. Additionally, the arrow may cause damage to the surrounding environment either from the force exerted by the arrow or from the pollution to the environment resulting from lost or un-recovered arrows. Further, the arrow may otherwise alert the hunted game to the presence of the hunters, for example, by providing an unnatural or unfamiliar scent or odor. What is needed then is an inexpensive, reusable, and inexpensive device that allows a crossbow to be returned to be un-cocked or returned to an un-drawn condition without damaging the crossbow or the environment.

II. SUMMARY OF THE INVENTION

According to one embodiment of the invention, a device may comprise a tip portion, a notched portion, and a scent capillary. The tip portion may comprise a compression zone. The compression zone is located at a first end of the tip portion and comprises at least a first collapsing aperture. The notched portion may comprise a nock and a vane portion. The nock may be shaped to receive a bowstring. The vane portion may at least partially increase the aerodynamic properties of the device. The scent capillary may cause a scent to be released upon the device being fired from a crossbow.

According to one embodiment of the invention, a device may comprise a tip portion, a notched portion, a scent capillary, and a directional marking. The tip portion may comprise a compression zone. The compression zone is located at a first end of the tip portion and comprises at least a first collapsing aperture. The notched portion may comprise a nock and a vane portion. The nock may be shaped to receive a bowstring. The vane portion may at least partially increase the aerodynamic properties of the device. The scent capillary may cause a scent to be released upon the device being fired from a crossbow. The directional marking may indicate the proper positioning of the device on the crossbow.

According to one embodiment of the invention, a device may comprise a tip portion, a notched portion, and a scent capillary. The tip portion may comprise a compression zone. The compression zone is located at a first end of the tip portion and comprises at least a first collapsing aperture. The notched portion may comprise a nock and a vane portion. The nock may be shaped to receive a bowstring. The vane portion may at least partially increase the aerodynamic properties of the device. The scent capillary may cause a scent to be released upon the device being fired from a crossbow. The device may further comprise a one-piece design, wherein the tip portion and the notched portion comprise a substantially unitary member having an elongated, substantially cylindrical shape.

According to one embodiment of the invention, a device may comprise a tip portion, a notched portion, and a scent capillary. The tip portion may comprise a compression zone.

The compression zone is located at a first end of the tip portion and comprises at least a first collapsing aperture. The notched portion may comprise a nock and a vane portion. The nock may be shaped to receive a bowstring. The vane portion may at least partially increase the aerodynamic properties of the device. The scent capillary may cause a scent to be released upon the device being fired from a crossbow. The device may comprise a multi-piece design. The multi-piece design may comprise a coupling assembly. The coupling portion may allow for the selective coupling of the tip portion and the notched portion to form an elongated member having a substantially cylindrical shape.

According to one embodiment of the invention, a device may comprise a tip portion, a notched portion, and a scent capillary. The tip portion may comprise a compression zone. The compression zone is located at a first end of the tip portion and comprises at least a first collapsing aperture. The notched portion may comprise a nock and a vane portion. The nock may be shaped to receive a bowstring. The vane portion may at least partially increase the aerodynamic properties of the device. The scent capillary may cause a scent to be released upon the device being fired from a crossbow. The device may comprise a multi-piece design. The multi-piece design may comprise a coupling assembly. The coupling portion may allow for the selective coupling of the tip portion and the notched portion to form an elongated member having a substantially cylindrical shape. The coupling portion may comprise a first and a second coupling portion. The first coupling portion may be formed at a first end of the tip portion and may comprise a reduced diameter portion that can be received by a recess formed in a first end of the notched portion. The second coupling portion may selectively retain the first coupling portion within the recess.

According to one embodiment of the invention, a device may comprise a tip portion, a notched portion, and a scent capillary. The tip portion may comprise a compression zone. The compression zone is located at a first end of the tip portion and comprises at least a first collapsing aperture. The notched portion may comprise a nock and a vane portion. The nock may be shaped to receive a bowstring. The vane portion may at least partially increase the aerodynamic properties of the device. The scent capillary may cause a scent to be released upon the device being fired from a crossbow. The tip portion may further comprise a second nock that is shaped to receive the bowstring.

According to one embodiment of the invention, a device may comprise a tip portion, a notched portion, and a scent capillary. The tip portion may comprise a compression zone. The compression zone is located at a first end of the tip portion and comprises at least a first collapsing aperture. The notched portion may comprise a nock and a vane portion. The nock may be shaped to receive a bowstring. The vane portion may at least partially increase the aerodynamic properties of the device. The scent capillary may cause a scent to be released upon the device being fired from a crossbow. The tip portion may further comprise a second nock that is shaped to receive the bowstring. The notched portion may further comprise a second collapsing zone having at least a first collapsing aperture.

According to one embodiment of the invention, a device may comprise a body portion, a tip portion, and a notched portion. The tip portion may comprise a first outer shell. The first outer shell may define a first interior recess. The notched portion may comprise a second outer shell, a nock, and a vane portion. The second outer shell may define a second interior recess. The nock may be shaped to receive a bowstring. The vane portion may at least partially increase the aerodynamic properties of the device. The tip portion and the notched portion can be selectively attached to the body portion to form an elongated member having a substantially cylindrical shape that can be used to un-cock a crossbow.

According to one embodiment of the invention, a device may comprise a body portion, a tip portion, and a notched portion. The tip portion may comprise a first outer shell. The first outer shell may define a first interior recess. The notched portion may comprise a second outer shell, a nock, and a vane portion. The second outer shell may define a second interior recess. The nock may be shaped to receive a bowstring. The vane portion may at least partially increase the aerodynamic properties of the device. The tip portion and the notched portion can be selectively attached to the body portion to form an elongated member having a substantially cylindrical shape that can be used to un-cock a crossbow. The device may further comprise a compression zone located at a first end of the tip portion. In one embodiment, the device may comprise a reusable device comprising a biodegradable composition.

According to one embodiment of the invention, a device may comprise a body portion, a tip portion, and a notched portion. The tip portion may comprise a first outer shell. The first outer shell may define a first interior recess. The notched portion may comprise a second outer shell, a nock, and a vane portion. The second outer shell may define a second interior recess. The nock may be shaped to receive a bowstring. The vane portion may at least partially increase the aerodynamic properties of the device. The tip portion and the notched portion can be selectively attached to the body portion to form an elongated member having a substantially cylindrical shape that can be used to un-cock a crossbow. The device may further comprise a compression zone located at a first end of the tip portion and a second compression zone located on the notched portion.

According to one embodiment of the invention, a device may comprise a body portion, a tip portion, and a notched portion. The tip portion may comprise a first outer shell. The first outer shell may define a first interior recess. The notched portion may comprise a second outer shell, a nock, and a vane portion. The second outer shell may define a second interior recess. The nock may be shaped to receive a bowstring. The vane portion may at least partially increase the aerodynamic properties of the device. The tip portion and the notched portion can be selectively attached to the body portion to form an elongated member having a substantially cylindrical shape that can be used to un-cock a crossbow. The device may further comprise a compression zone located at a first end of the tip portion and a second compression zone located on the notched portion. A collapsing aperture may be positioned within the first or second compression zone.

According to one embodiment of the invention, a device may comprise a body portion, a tip portion, and a notched portion. The tip portion may comprise a first outer shell. The first outer shell may define a first interior recess. The notched portion may comprise a second outer shell, a nock, and a vane portion. The second outer shell may define a second interior recess. The nock may be shaped to receive a bowstring. The vane portion may at least partially increase the aerodynamic properties of the device. The tip portion and the notched portion can be selectively attached to the body portion to form an elongated member having a substantially cylindrical shape that can be used to un-cock a crossbow. The device may further comprise a compression zone located in the body portion.

According to one embodiment of the invention, a device may comprise a body portion, a tip portion, and a notched portion. The tip portion may comprise a first outer shell. The first outer shell may define a first interior recess. The notched portion may comprise a second outer shell, a nock, and a vane portion. The second outer shell may define a second interior recess. The nock may be shaped to receive a bowstring. The vane portion may at least partially increase the aerodynamic properties of the device. The tip portion and the notched portion can be selectively attached to the body portion to form an elongated member having a substantially cylindrical shape that can be used to un-cock a crossbow. The device may further comprise a scent capillary. The scent capillary may cause the device to emit an odor designed to lure game animals or to mask an unnatural scent upon being fired from the crossbow.

According to one embodiment of the invention, a device may comprise a body portion, a tip portion, and a notched portion. The tip portion may comprise a first outer shell. The first outer shell may define a first interior recess. The notched portion may comprise a second outer shell, a nock, and a vane portion. The second outer shell may define a second interior recess. The nock may be shaped to receive a bowstring. The vane portion may at least partially increase the aerodynamic properties of the device. The tip portion and the notched portion can be selectively attached to the body portion to form an elongated member having a substantially cylindrical shape that can be used to un-cock a crossbow. The device may further comprise a scent capillary. The scent capillary may cause the device to emit an odor designed to lure game animals or to mask an unnatural scent upon being fired from the crossbow. The scent capillary may be positioned at least partially within the first interior recess.

According to one embodiment of the invention, a device may comprise a body portion, a tip portion, and a notched portion. The tip portion may comprise a first outer shell. The first outer shell may define a first interior recess. The notched portion may comprise a second outer shell, a nock, and a vane portion. The second outer shell may define a second interior recess. The nock may be shaped to receive a bowstring. The vane portion may at least partially increase the aerodynamic properties of the device. The tip portion and the notched portion can be selectively attached to the body portion to form an elongated member having a substantially cylindrical shape that can be used to un-cock a crossbow. The device may further comprise a scent capillary. The scent capillary may cause the device to emit an odor designed to lure game animals or to mask an unnatural scent upon being fired from the crossbow. The device may further comprise a compression zone. The compression zone may be designed to at least partially deform upon a force being exerted on the device. The deformation of the compression zone may at least partially cause the scent capillary to emit the odor.

According to one embodiment of the invention, a device may comprise a body portion, a tip portion, and a notched portion. The tip portion may comprise a first outer shell. The first outer shell may define a first interior recess. The notched portion may comprise a second outer shell, a nock, and a vane portion. The second outer shell may define a second interior recess. The nock may be shaped to receive a bowstring. The vane portion may at least partially increase the aerodynamic properties of the device. The tip portion and the notched portion can be selectively attached to the body portion to form an elongated member having a substantially cylindrical shape that can be used to un-cock a crossbow. The device may further comprise a biodegradable composition.

One advantage of this invention is the user is not required to retain an arrow specifically for the purpose of returning the crossbow to an undrawn condition. Additionally, the invention provides a relatively inexpensive, lightweight, reusable, and easily transported device for un-cocking the crossbow that will not harm the environment if it cannot be retrieved or recovered after being fired.

Still other benefits and advantages of the invention will become apparent to those skilled in the art to which it pertains upon a reading and understanding of the following detailed specification.

III. BRIEF DESCRIPTION OF THE DRAWINGS

The invention may take physical form in certain parts and arrangement of parts, a preferred embodiment of which will be described in detail in this specification and illustrated in the accompanying drawings which form a part hereof and wherein.

IV. DETAILED DESCRIPTION OF THE INVENTION

Figure 1:
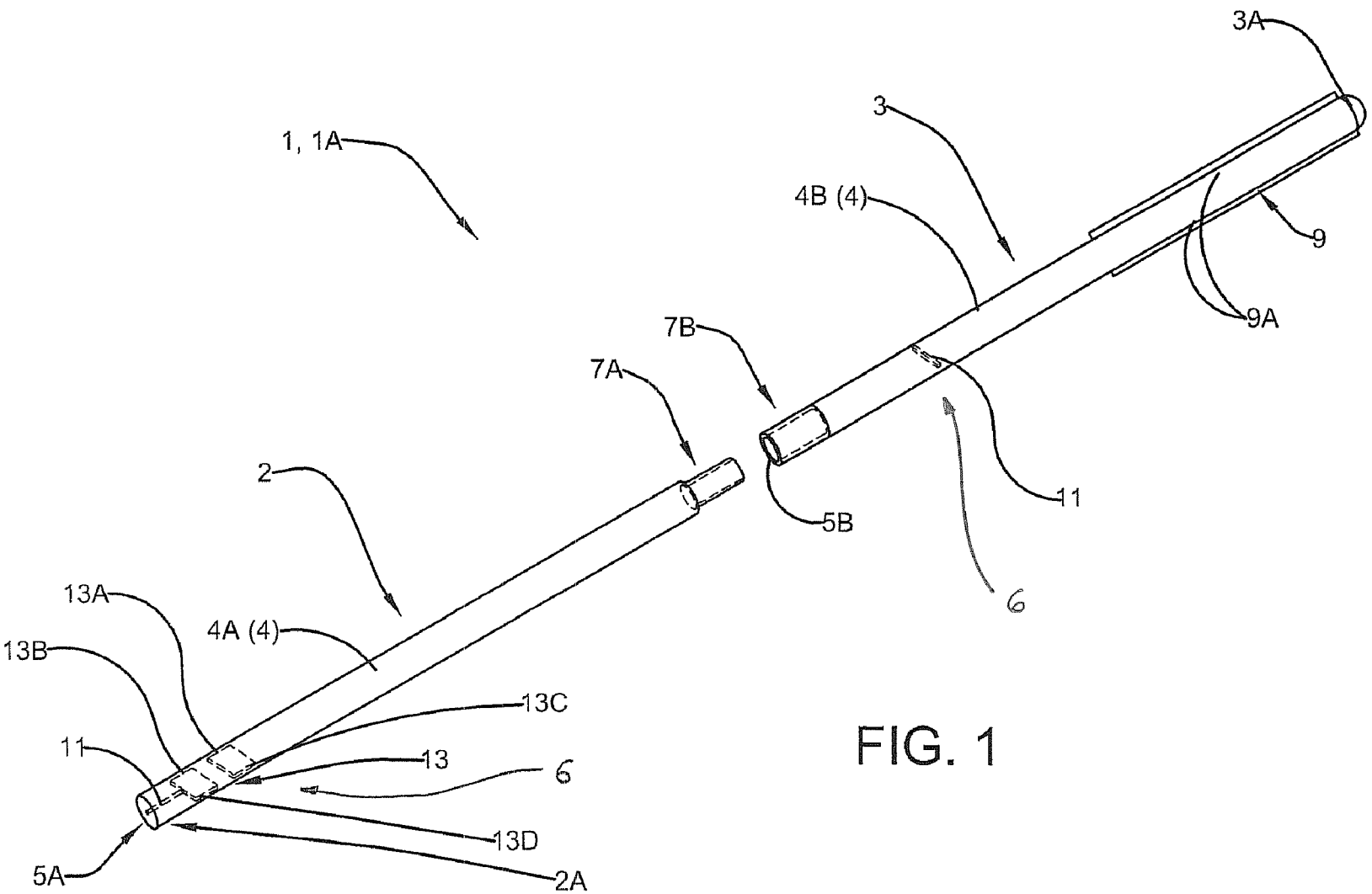
FIG. 1 shows a perspective view of a multi-piece unloading bolt according to one embodiment of the invention.

Referring now to the drawings wherein the showings are for purposes of illustrating embodiments of the invention only and not for purposes of limiting the same, FIG. 1 shows an unloading bolt 1 according to one embodiment of the invention. The unloading bolt 1 may comprise a device that allows a user to release a drawn bowstring 52 without damaging the crossbow 10. The unloading bolt 1 may comprise a lightweight and reusable device that provides users a cost-effective means for releasing the drawn bowstring that replaces the practice arrow commonly used for the same purpose. In one embodiment, the unloading bolt 1 may comprise a biodegradable device or a device that otherwise will not harm the environment if the unloading bolt 1 cannot be retrieved or recovered after being used to return the bowstring 52 to an undrawn condition.

With reference now to FIGS. 1-4, the unloading bolt 1 may comprise an elongated, substantially cylindrical shape that substantially resembles a conventional arrow or bolt. The unloading bolt 1 may comprise a mass having sufficient size and weight to absorb an amount of energy imparted on the unloading bolt 1 when fired from the crossbow 10 sufficient to prevent the crossbow 10 from being otherwise damaged. The unloading bolt 1 may range from about 6 inches to about 40 inches in length and may weigh from about 8 ounces to about 3 pounds. In another embodiment, the unloading bolt 1 may range from about 6 inches to about 22 inches in length and may weigh from about 0.8 ounces to about 3 ounces. In yet another embodiment, the unloading bolt 1 may be about 30 inches in length and may weigh about 1 pound. The unloading bolt 1 may comprise a biodegradable or other type of material designed to prevent or reduce harm caused to the environment. In one embodiment, the unloading bolt 1 may comprise a biopolymer or a biodegradable thermoplastic such as a polylactic acid. In another embodiment, the unloading bolt 1 may comprise a poly starch or thermo-plastical starch material. In yet another embodiment, the unloading bolt 1 may comprise a non-biodegradable composition such as, for example, steel or aluminum. The unloading bolt 1 may comprise any type of material chosen with sound judgment by a person of ordinary skill in the art.

Figure 2:
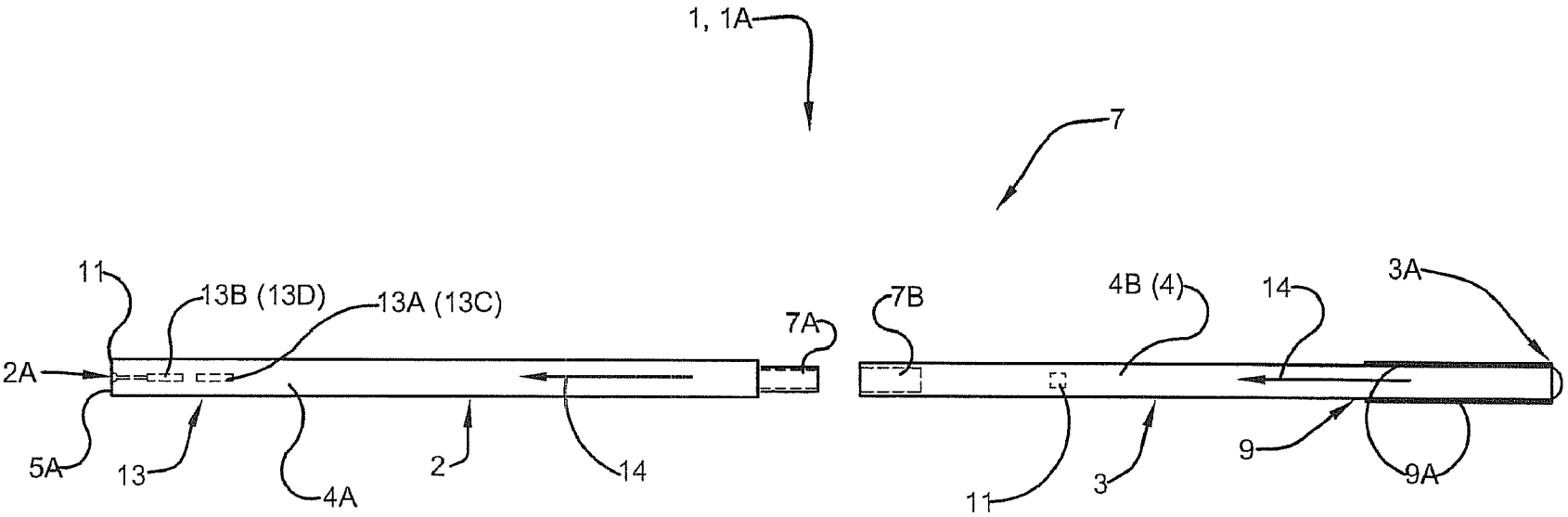
FIG. 2 shows an elevation view of the multi-piece unloading bolt shown in FIG. 1.
Figure 3:
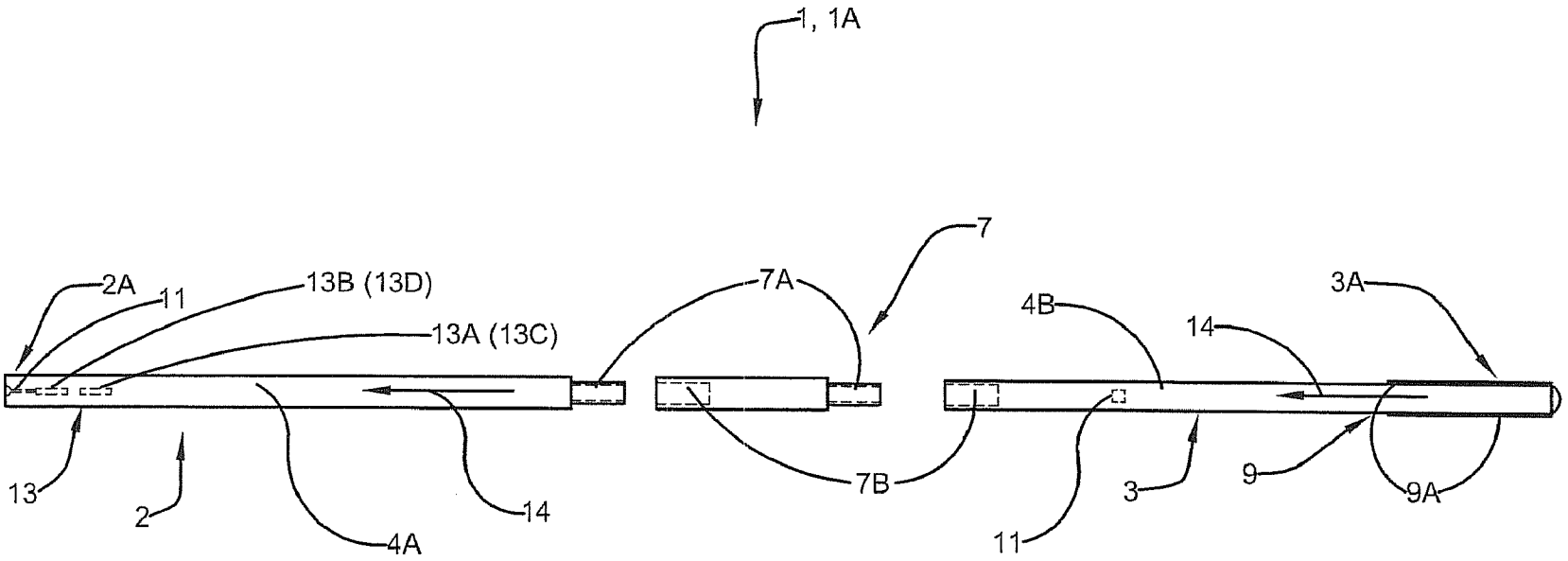
FIG. 3 shows an elevation view of a multi-piece unloading bolt according to one embodiment of the invention.

With reference now to FIGS. 1-3, the unloading bolt 1 may comprise either a multi- or single-piece design. In one embodiment, the unloading bolt 1 may comprise a multi-piece design 1*a*, shown in FIG. 1, which can be selectively assembled and disassembled by the user. The multi-piece design 1*a* may comprise any number of pieces or components chosen with sound judgment by a person of ordinary skill in the art. The multi-piece design 1*a* may increase the portability, functionality, and utility of the unloading bolt 1. In one embodiment, the multi-piece design 1*a* may increase the portability of the unloading bolt 1 by allowing the user to transport the unloading bolt 1 in a disassembled condition thereby reducing the amount of space necessary to store or transport the unloading bolt 1. The multi-piece design 1*a* may increase the functionality and utility of the unloading bolt 1 by allowing for the interchanging of various pieces of the unloading bolt 1. In one embodiment, the multi-piece design 1*a* may allow for the replacement of a damaged or worn piece of the unloading bolt rather than requiring replacement of the entire unloading bolt 1. Additionally, the multi-piece design 1*a* may allow for the interchangeability of various pieces of the unloading bolt 1 thereby allowing the user to alter one or more properties of the unloading bolt 1 depending upon the specific environment or conditions encountered by the user. In another embodiment, the unloading bolt 1 may comprise the single-piece design 1*b*, shown in FIG. 4. The single-piece design 1*b* may comprise a single structure that is substantially similar to the multi-piece design 1*a* when assembled. In one embodiment, the single piece design 1*b* may comprise an embodiment of the multi-piece design 1*a* wherein the multi-piece design 1*a* comprises a design that prevents the disassembly of the unloading bolt 1 once assembled.

With reference now to FIGS. 1-4, the unloading bolt 1 will be described. Components or elements described pertain to both the multi-piece design 1*a* and the single-piece design 1*b* except as specifically noted below. The unloading bolt 1 may comprise a body 4 having an elongated, substantially cylindrical shape. The body 4 may comprise a shape that is similar to that of a conventional arrow, not shown. The body 4 may comprise a tip portion 2 and a notched portion 3. In one embodiment, the unloading bolt 1 may comprise the single-piece design 1*b*, shown in FIG. 4, wherein the body 4 comprising the tip portion 2 and the notched portion 3 forming an integral or unitary member. In another embodiment, the unloading bolt 1 may comprise the multi-piece design 1*a*, shown in FIG. 2, wherein the body 4 comprises the tip portion 2 and the notched portion 3, wherein the tip portion 2 and the notched portion 3 comprise separate components that can be selectively coupled to form the body 4, thereby forming a unitary member that is substantially similar to that of the single-piece design 1*b*. In another embodiment, the unloading bolt 1 may comprise the multi-piece design 1*a* wherein the body 4 comprises a separate component from the tip portion 2 and the notched portion 3. The unloading bolt 1 may be formed or assembled by operatively connecting the tip portion 2 and the notched portion 3 to the body 4.

With reference now to FIGS. 1-3, the tip portion 2 may comprise a first outer shell 4*a* having an elongated, substantially cylindrical shape. The outer shell 4*a* may define a first interior recess 5*a*, shown in FIG. 1. A first end 2*a* of the tip portion 2 may comprise a compression zone 6. The compression zone 6 may at least partially cause the tip portion 2 to compress or deform upon a force being exerted on the unloading bolt 1, for example, such as when the unloading bolt 1 strikes a solid object, such as a tree or a rock. The compression zone 6 may reduce the damage caused to the environment by absorbing or reducing at least a portion of the force exerted on an object, for example, a tree, struck by the unloading bolt 1. In one embodiment, the compression zone 6 may comprise a collapsing aperture 13. The collapsing aperture 13 may be formed in the first outer shell 4*a* and may at least partially facilitate the deformation of the compression zone 6. In one embodiment, the compression zone 6 may comprise a plurality of collapsing apertures 13. In a more specific embodiment, the compression zone 6 may comprise a first, second, third, and fourth collapsing aperture 13*a*, 13*b*, 13*c*, 13*d*. The first collapsing aperture 13*a* may be positioned radially above the second collapsing aperture 13*b* substantially along a common axis. The third collapsing aperture 13*c* may be positioned radially above the fourth collapsing aperture 13*d*. The first and second collapsing apertures 13*a*, 13*b* may be positioned axially away from and substantially aligned with the third and fourth collapsing apertures 13*c*, 13*d*, respectively. In one embodiment, the first, second, third, and fourth collapsing aperture 13*a*, 13*b*, 13*c*, 13*d* may comprise separate and distinct collapsing apertures and the first and second collapsing apertures 13*a*, 13*b* may be positioned directly opposite of the third and fourth collapsing apertures 13*c*, 13*d* such that the first and second collapsing apertures 13*a*, 13*b* are formed in the outer shell 4*a* at a position that is about 180 degrees from the position of the third and fourth collapsing apertures 13*c*, 13*d*. The collapsing zone 6 may comprise any number of collapsing apertures 13 chosen with sound judgment by a person of ordinary skill in the art. In yet another embodiment, the collapsing zone 6 and/or the collapsing apertures 13 may be omitted from the tip portion 2.

With reference now to FIGS. 1-4, the notched portion 3 may comprise a second outer shell 4*b* having an elongated, substantially cylindrical shape. The second outer shell 4*b* may define a second interior recess 5*b*. In one embodiment, the notched portion 3 may comprise substantially the same size and weight as the tip portion 2. The notched portion 3 may comprise a nock 3*a*. The nock 3*a* may comprise a shape that is suitable for receiving the bowstring 52 of the crossbow 10. In one embodiment, the nock 3*a* may comprise substantially the same shape as the notched end or the nock of a conventional arrow, not shown. The nock 3*a* may comprise any shape chosen with sound judgment by a person of ordinary skill in the art. In one embodiment, the notched portion 3 may optionally comprise a vane portion 9. The vane portion 9 may at least partially increase the aerodynamic properties of the unloading bolt 1 similar to that of the fletching on a conventional arrow. In one embodiment, the vane portion 9 may comprise a plurality of raised ridges 9*a*. The raised ridges 9*a* may extend axially from at least a portion of the notched portion 3, the body 4, and/or the tip portion 2. The raised ridges 9*a* may be substantially evenly spaced circumferentially around the second outer shell 4*b*. The raised ridges 9*a* may be formed of the same composition as the tip portion 2, the body 4, and/or the notched portion 3. In one embodiment, the raised ridges 9*a* may be formed of a different composition then the unloading bolt 1. The vane portion 9 may comprise any number of raised ridges 9*a* located at any position along the exterior surface of the notched portion 3, the body 4, and/or the tip portion 2 chosen with sound judgment by a person of ordinary skill in the art. The vane portion 9 may comprise any shaped appendage designed to at least partially increase the aerodynamic properties of the unloading bolt 1 chosen with sound judgment by a person of ordinary skill in the art.

With reference now to FIGS. 1-2, in one embodiment, the unloading bolt 1 may comprise a coupling assembly 7, shown in FIG. 1. The coupling assembly 7 may allow for the assembly or disassembly of the unloading bolt 1. In one embodiment, the coupling assembly 7 may comprise a first coupling portion 7*a* and a second coupling portion 7*b*. The first coupling portion 7*a* may be formed at the second end 2*b* of the tip portion 2 and the second coupling portion 7*b* may be formed at the second end 3*b* of the notched portion 3. In one embodiment, the first coupling portion 7*a* may comprise a reduced diameter portion that is at least partially received into the second interior recess 5*b*. The second coupling portion 7*b* may selectively retain the first coupling portion within the second recess 5*b*. In one embodiment, the first coupling portion 7*a* may comprise a plurality of grooves 8*a* and a retaining protrusion 9*a*. The retaining protrusion 9*a* may comprise a semi-flexible portion that extends above the surface of the second outer shell 4*b*. The plurality of grooves may be received by corresponding slots 8*b* formed in the interior surface of the second outer shell 4*b*. Upon initially inserting the first coupling portion 7*a* into the second interior recess 5*b*, the interior surface of the second outer shell 4*b* may urge the retaining protrusion 9*a* downwards at least partially into the first interior recess 5*a*. The slots 8*b* may be position such that upon inserting the first coupling portion 7*a* a predetermined distance into the second interior recess 5*b*, the retaining protrusion 9*a* aligns with and extends at least partially through a retaining aperture 9*b* formed through the second outer shell 4*b*. To uncouple the tip portion 2 from the notched portion 3, the retaining protrusion 9*a* may be forced downward below the interior surface of the second outer shell 4*b* thereby allowing the first coupling portion 7*a* to be removed from within the second interior recess 5*b*.

With reference now to FIGS. 1-4, the unloading bolt 1 may comprise a scent capillary 11. In one embodiment, the unloading bolt 1 may comprise a plurality of scent capillaries 11. The scent capillary 11 may be positioned and designed such that, the firing of the unloading bolt 1 from the crossbow 10 at least partially causes the scent capillary 11 to release an odor, smell, or scent designed to attract or lure game animals, such as, for example, deer, or to mask an unnatural scent. The scent capillary 11 may be positioned at least partially within the first interior recess 5*a* and/or the second interior recess 5*b*. In one embodiment, the scent capillary 11 may release the scent upon the deformation of the compression zone 6. In a more specific embodiment, the scent capillary 11 may be positioned at least partially within the compression zone 6 such that the deformation of the compression zone 6 causes the scent capillary 11 to release the scent. It will be appreciated that the fired unloading bolt 1 will undergo an impact load upon striking a target, that this impact load will be substantially along the length of the unloading bolt, and that this impact load may be transmitted to the features of unloading bolt 1. As shown in FIGS. 1-4, scent capillary 11 is elongated along the length of the unloading bolt. It will be appreciated that the impact load may buckle, barrel, otherwise deform the capillary in directions transverse to the length of the capillary and, as noted above, cause the scent capillary 11 to release the scent. Also, as shown in FIGS. 1-4, in some embodiments scent capillary 11 may intersect or tie in with a collapsing aperture 13. As shown in FIGS. 1-4 a collapsing aperture 13 tied in with a scent capillary 11 may be is elongated at least along the length of the unloading bolt. It will be appreciated that the impact load may buckle, barrel, otherwise deform collapsing aperture 13 in directions transverse to the elongation of the collapsing aperture 13, creating or dilating, at least temporarily, an opening or path through which the scent may be released. In another embodiment, the scent capillary 11 may be positioned substantially within the first interior recess 5*a* and positioned between the first end 2*a* and the compression zone 6. In yet another embodiment, the scent capillary 11 may be positioned adjacent to the first end 2*a* of the tip portion 2. In one embodiment, the first end 2*a* of the tip portion 2 may comprise an open end or an aperture that allows for the positioning of the scent capillary 11 within the first interior recess 5*a*.

With continuing reference to FIGS. 1-4, in one embodiment, the scent capillary 11 may enclose or otherwise contain a scented fluid such the breaking or rupturing of the scent capillary 11 causes the scent to be released. In one embodiment, the scent capillary 11 may comprise a biodegradable material that encloses or contains the scented fluid. In another embodiment, the scent capillary 11 may comprise a composition that at least partially absorb the scented fluid or carry the scented fluid on its surface such that exposing the scent capillary 11 to the ambient air causes the scent to be released. In one embodiment, the scent capillary 11 may comprise a paper composition, a cotton composition, or a combination thereof. In another embodiment, the scent capillary 11 may comprise a portion of the body 4. The scent may be applied to at least a portion of the first exterior surface 4*a* and/or the second exterior surface 4*b*. The scent may be applied to at least a portion of the first exterior surface 4*a* and/or the second exterior surface 4*b* such that the scent is released upon that portion of the body 4 being rubbed, contacted, or abraded. The scent capillary 11 may comprise any composition suitable for absorbing or otherwise carrying a scented fluid chosen with sound judgment by a person of ordinary skill in the art. Scented fluids designed to attract or lure game animals or to mask unnatural scents are well known and widely used in the art and therefore are not described herein.

With continuing reference to FIGS. 1-4, the unloading bolt 1 may comprise a multi-piece design 1*a* that allows for the interchangeability of the various pieces comprising the body 4. In one embodiment, the unloading bolt 1 may allow for the interchangeability of the tip portion 2 and the notched portion 3 thereby allowing the body 4 to comprise a first and a second notched portion 3. Stated differently, the unloading bolt 1 may allow the tip portion 2 to be selectively replaced with a second notched portion 3 that is substantially identical to the first notched portion 3. The second notched portion 3 may allow the unloading bolt 1 to be used with either end receiving the bowstring 52. In another embodiment, the tip portion 2 and the notched portion 3*a* may each comprise a nock 3*a* thereby allowing the body 4 to comprise a first and second tip portion 2. In yet another embodiment, the unloading bolt 1 may comprise a three-piece design wherein the body 4 may be interchanged with the tip portion 2.

With continuing reference to FIGS. 1-4, the tip portion 2 and/or the notched portion 3 may comprise directional markings 14 that indicate the proper positioning of the unloading bolt 1 when used with the crossbow 10. In one embodiment, the directional markings 14 may comprise the wording "This End Forward" and/or one or more directional arrows that point from the notched end 3*a* to the first end 2*a* of the tip portion 2, thereby indicating the proper direction of flight for the unloading bolt 1. In another embodiment, the directional markings 14 may comprise other writings or symbols indicating the location of the bowstring 52 and/or the bow assembly 50 relative to the unloading bolt 1. The directional markings 14 may comprise any type of indicia suitable for indicating the proper placement of the unloading bolt 1 chosen with sound judgment by a person of ordinary skill in the art.

Figure 4:
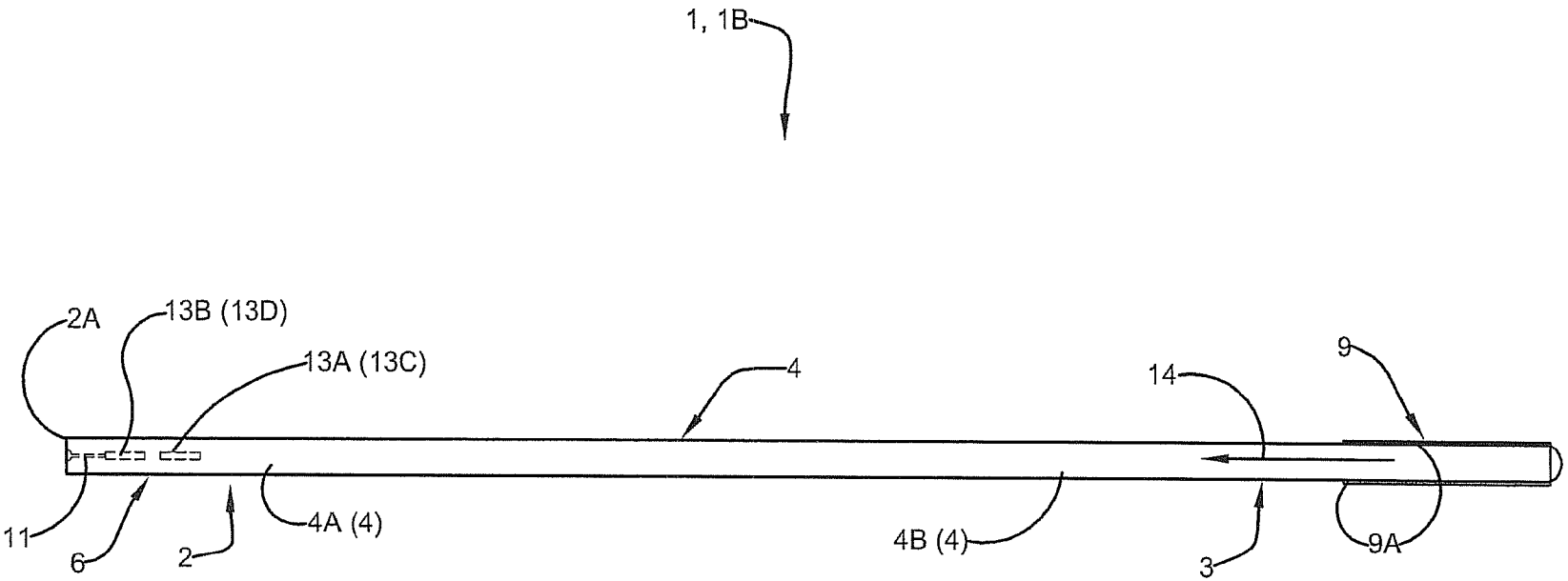
FIG. 4 shows an elevation view of a single-piece unloading bolt according to one embodiment of the invention.
Figure 5:
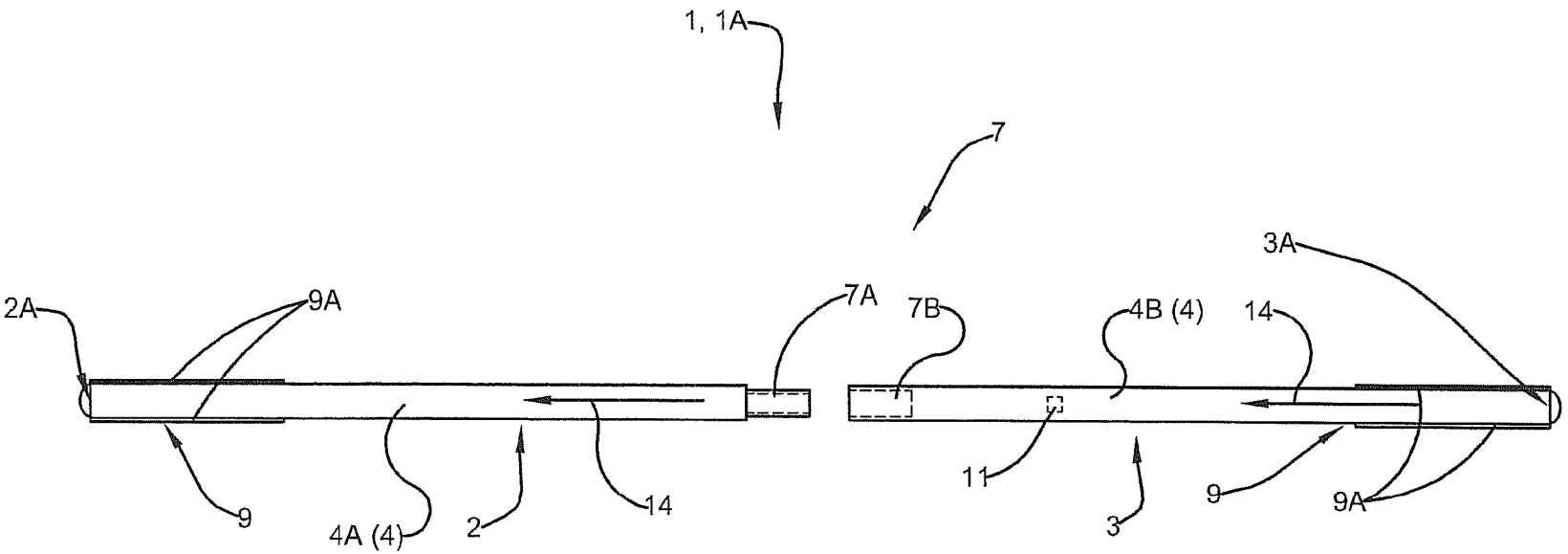
FIG. 5 shows an elevation view of a multi-piece unloading bolt having a body comprising a first and second notched portions according to one embodiment of the invention.
Figure 6:
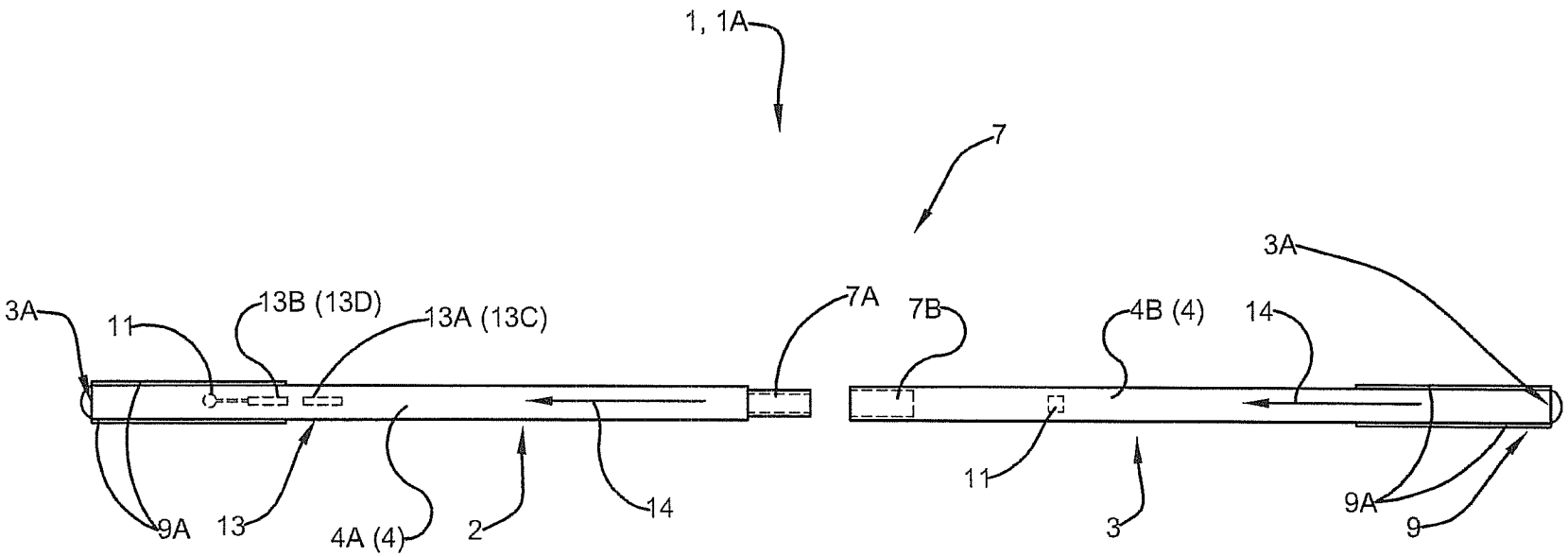
FIG. 6 shows an elevation view of a multi-piece unloading bolt having a tip portion comprising a nock according to one embodiment of the invention.
Figure 7:
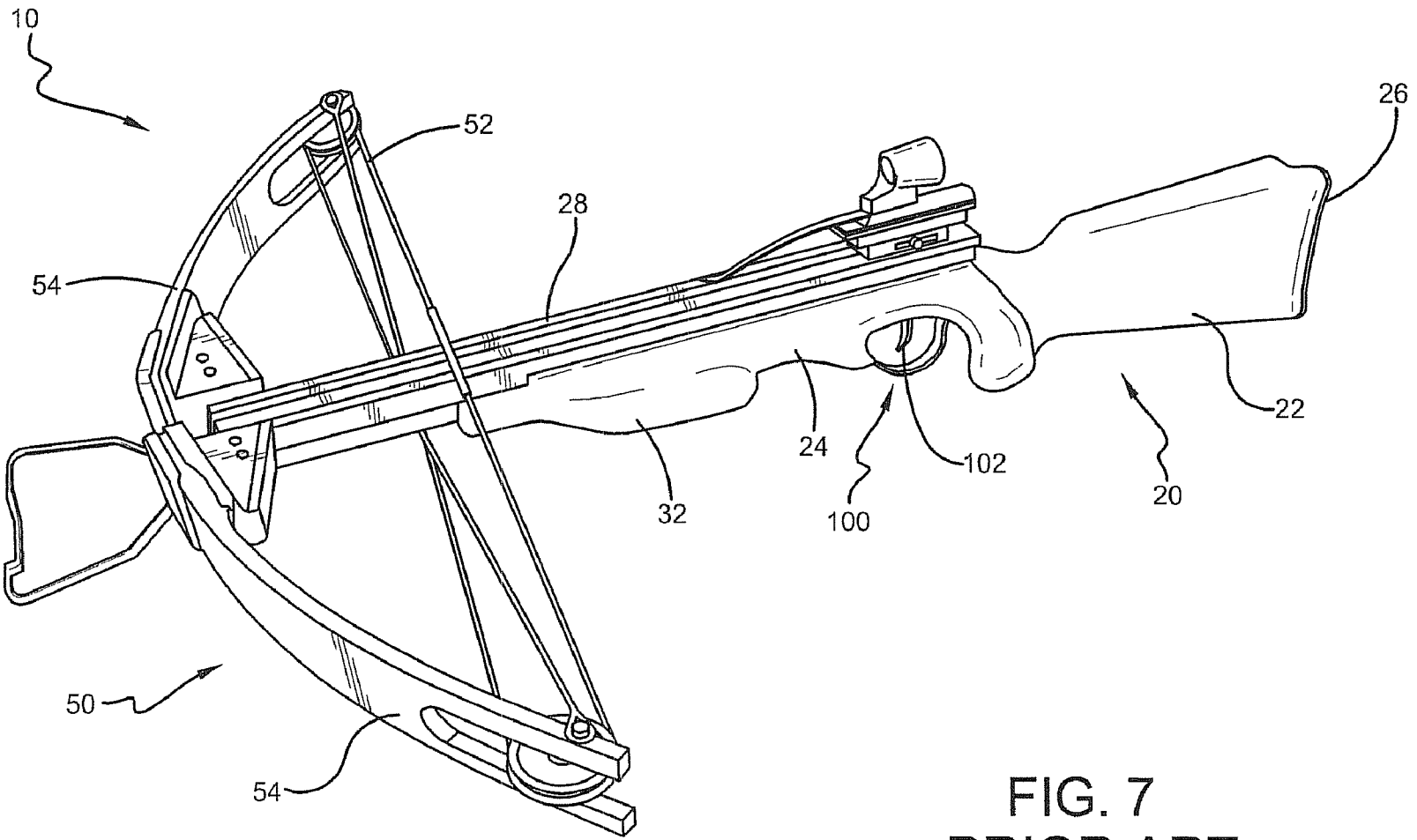
FIG. 7 PRIOR ART
FIG. 7 shows a perspective view of a prior art crossbow suitable for use with an unloading bolt according to one embodiment of the invention.

FIG. 4 shows a crossbow 10 for use with the unloading bolt 1. Crossbows are well known in the art and will only be generally described. Although a particular design of the crossbow 10 is shown, the unloading bolt 1 may be used with any type of crossbow chosen with sound judgment by a person of ordinary skill in the art. The type of crossbow, or components thereof, is not intended as a limitation of the unloading bolt 1. The crossbow 10 may generally include a stock member 20, a bow portion 50, and a trigger assembly 100. The trigger assembly 100 may be associated with the stock member 20 for selectively holding and releasing the bowstring 52. The bow portion 50 may comprise two outwardly extending limb members 54 that extend transversely on opposite sides from the stock member 20. The bowstring 52 may be operatively connected to and extend between the ends of the limb members 54 such that as the bowstring 52 is drawn and held by the trigger assembly 100, the limb members 54 are tensioned, thereby storing energy that is released upon release of the bowstring 52 from the trigger assembly 100 to propel an arrow or the unloading bolt 1. The stock member 20 may generally comprise a rear portion or tailstock 22 and a forestock or barrel 24. The tailstock 22 may comprise an integrally formed butt portion 26 that is normally positioned against the user's shoulder when the crossbow 10 is being aimed or fired. The barrel 24 may comprise a hollow, extruded member that provides added structural integrity to the crossbow 10 that is normally held by the user when the crossbow 10 is being aimed or fired. In one embodiment, the barrel 24 may comprise a separate member formed of a strong, lightweight material, such as aluminum. In another embodiment, the barrel 24 may be integral to the tailstock 22. The barrel 24 may comprise an upper surface 28. The upper surface 28 may comprise a flat surface on which the bowstring 52 may slide in operation of the crossbow 10. The trigger assembly 100 may comprise a guide 102 and a trigger lever 104. The bowstring 52 may be retracted to and held within the guide 102, thereby constituting the drawn position. To return the crossbow 10 to an un-drawn position the unloading bolt 1 may be placed on the upper surface of the barrel 24 such that the nock 3*a* receives or is positioned adjacent to the bowstring 52. Actuation of the trigger lever 104 may release the bowstring 52 thereby propelling the unloading bolt 1 and preventing the crossbow 10 from being otherwise damaged as the bowstring 52 is released or returned to the un-drawn position.

The embodiments have been described, hereinabove. It will be apparent to those skilled in the art that the above methods and apparatuses may incorporate changes and modifications without departing from the general scope of this invention. It is intended to include all such modifications and alterations in so far as they come within the scope of the appended claims or the equivalents thereof.

What is claimed is:

1. A bolt comprising:
a tip portion,
comprising a first compression zone located at a first end of the tip portion; and
comprising a unitary structure fully defining a first collapsing aperture
said unitary structure adapted to absorb kinetic energy by undergoing deformation,
said deformation occurring in such a way that the deformation substantially plastically deforms both the unitary structure and the first collapsing aperture;
a notched portion comprising:
a nock, wherein the nock shaped to receive a bowstring;
a vane portion, wherein the vane portion at least partially increases the aerodynamic properties of the device; and,
a scent capillary, wherein the scent capillary
causes a scent to be released upon the device being fired from a crossbow.

2. The bolt of claim 1, further comprising:
a directional marking comprising a writing or a symbol adapted to indicate the proper positioning of the bolt on the crossbow.

3. The bolt of claim 1, further comprising:
a multi-piece design comprising a coupling assembly, wherein the coupling assembly allows for the selective coupling of the tip portion and the notched portion to form an elongated member having a substantially cylindrical shape.

4. The bolt of claim 3, wherein the coupling assembly comprises:
a first coupling portion, wherein the first coupling portion is formed at a second end of the tip portion and comprises a reduced diameter portion that can be received by a recess formed in a first end of the notched portion;
a second coupling portion, wherein the second coupling portion selectively retains the first coupling portion within the recess.

5. The bolt of claim 1, wherein the tip portion further comprises:
a second nock shaped to receive the bowstring.

6. The bolt of claim 5, wherein the notched portion further comprises:
a second collapsing zone having at least a first collapsing aperture.

7. The bolt of claim 1, wherein the device comprises a reusable device comprising a biodegradable composition.

8. A bolt comprising:
a tip portion,
comprising a first compression zone located at a first end of the tip portion, and
comprising a unitary structure fully defining a first collapsing aperture
said unitary structure adapted to absorb kinetic energy by undergoing deformation,
said deformation occurring in such a way that the deformation substantially plastically deforms both the unitary structure and the first collapsing aperture;
a notched portion comprising,
a nock, wherein the nock shaped to receive a bowstring,
a vane portion, wherein the vane portion at least partially increases the aerodynamic properties of the device;
a scent capillary, wherein the scent capillary causes a scent to be released upon the device being fired from a crossbow; and
wherein the tip portion and the notched portion are integrally formed as a single piece design unitary member having an elongated, substantially cylindrical shape.

9. A bolt comprising:
a body portion;
a tip portion comprising,
a first outer shell, wherein the first outer shell defines a first interior recess;
a notched portion comprising, a second outer shell, wherein the second outer shell defines a second interior recess, a nock shaped to receive a bowstring, and a vane portion, that at least partially increases the aerodynamic properties of the device, wherein the tip portion and the notched portion can be selectively attached to the body portion to form an elongated member having a substantially cylindrical shape that can be used to un-cock a crossbow;

a first compression zone located at a first end of the tip portion, said first compression zone comprising a unitary structure defining a first collapsing aperture, said unitary structure adapted to absorb kinetic energy by undergoing plastic strain; and a second compression zone located on the notched portion, said second compression zone comprising a unitary structure defining a second collapsing aperture, said unitary structure adapted to absorb kinetic energy by undergoing plastic strain.

10. The bolt of claim 9, further comprising:

a scent capillary, wherein the scent capillary causes the device to emit an odor designed to lure game animals or to mask an unnatural scent upon being fired from a crossbow.

11. The bolt of claim 10, wherein the scent capillary is positioned at least partially within the first interior recess.

12. The bolt of claim 10, wherein either the first compression zone or the second compression zone is designed to undergo at least partial deformation upon a force being exerted on the bolt such that the partial deformation at least partially causes the scent capillary to emit the odor.

13. The bolt of claim 9, further comprising:

a biodegradable composition.

14. The bolt of claim 12, wherein said deformation that at least partially causes the scent capillary to emit the odor is plastic deformation.

* * * * *